US005887359A

United States Patent [19]

Falguere

[11] Patent Number: 5,887,359

[45] Date of Patent: Mar. 30, 1999

[54] PROTECTIVE GAITER FOR SHOE

[75] Inventor: Jean-Luc Falguere, Sales, France

[73] Assignee: Salomon S.A., Cedex, France

[21] Appl. No.: 697,727

[22] Filed: Aug. 29, 1996

[30] Foreign Application Priority Data

Sep. 6, 1995 [FR] France ..... 95 10588

[51] Int. Cl.[6] ..... A41D 17/00

[52] U.S. Cl. ..... 36/2 R; 36/1.5

[58] Field of Search ..... 36/2 R, 1.5

[56] References Cited

U.S. PATENT DOCUMENTS

| | | | |
|---|---|---|---|
| Re. 13,747 | 6/1914 | Woodward | 36/2 R |
| 448,819 | 3/1891 | Macomber | 36/2 R |
| 633,924 | 6/1899 | Chester | 36/2 R |
| 1,572,313 | 2/1926 | Sarar | 36/1.5 |
| 1,706,709 | 3/1929 | Rubin | 36/2 R |
| 1,794,506 | 3/1931 | Anderson | 36/2 R |
| 2,247,831 | 7/1941 | Asch et al. | 36/2 R |
| 2,438,308 | 3/1948 | Wheaton | 36/2 R |
| 2,532,024 | 11/1950 | Hoffman | 36/2 R |
| 2,857,688 | 10/1958 | Haase | 36/1.5 |
| 3,153,864 | 10/1964 | Brewer | 36/2 R |
| 4,896,437 | 1/1990 | Johnson | 36/2 R |

FOREIGN PATENT DOCUMENTS

| | | |
|---|---|---|
| 0 329 621 | 8/1989 | European Pat. Off. . |
| 1048160 | 12/1953 | France . |
| 1124735 | 10/1956 | France . |
| 253837 | 3/1926 | United Kingdom . |

*Primary Examiner*—M. D. Patterson
*Attorney, Agent, or Firm*—Pollock, Vande Sande & Amernick

[57] ABSTRACT

Water-proof protective gaiter for a boot having a tubular shape, of the type comprising, on the one hand, a lower portion (1) covering at least partially the upper (2) of a boot (3) in a front area of insertion of the user's foot, then of closure, whose lower end circumference (4, 4A) is designed to adopt the contour of said upper (2), and, on the other, an upper portion (6) designed to enclose the lower leg of said user. An at least partially peripheral flap (8) forming an extension of said circumference (4) extends from at least a portion of the end circumference (4) of the lower portion (1) of the gaiter, so as to extend the range of protection of the gaiter beyond this circumference.

6 Claims, 4 Drawing Sheets

PROTECTIVE GAITER FOR SHOE

FIELD OF THE INVENTION

The present invention concerns a water-tight protective gaiter having an overall tubular shape, of the type comprising a lower portion covering at least partially the upper of a shoe in an area of insertion and enclosure of the foot of a user and whose lower end circumference is fitted with enclosure means on said upper, and an upper portion designed to envelop the lower leg of the user.

BACKGROUND OF THE INVENTION

A gaiter of this type is sold commercially by the Berghaus Company and forms a supple boot designed to be put on over the shoe. It comprises an upper portion made of a water-tight fabric extending to a point below the user's knee, its main feature lying in the fact that the upper portion is extended by a lower portion which, in the manner of an outer shoe, encloses the entire shoe upper, including the sole thereof, by means of a plate designed to cover the sole which forms an extension of the circumference of the lower end of the gaiter itself and serves as the aforementioned enclosure means.

Although it probably gives good results, this gaiter has the disadvantage of being relatively complex and costly to manufacture. In addition, the presence of the plate on the boot sole, although incorporating open work, eliminates from the sole a portion of its ground-grabbing areas and makes it difficult to use with a ski boot, by virtue of the presence thereon of special binding means and, in addition, difficult to use with a hiking boot designed to incorporate studs for walking on ice. Furthermore, the size of the boot must be adhered to, thus requiring the stocking of inventory. Finally, and above all, this gaiter is especially difficult to put in place on the boot.

There also exists a gaiter made of a water-tight fabric, in which the circumference of the lower end is fitted with means for enclosing the upper tightly, which are constituted by an elastic strip mounted on the inner edge thereof, so as to envelop elastically the corresponding portion of the upper, connection to the sole being achieved by a cable of adjustable length extending beneath the arch and being clearly easier to put in place.

Nevertheless, this gaiter, which is more easily manufactured than the preceding one, has the disadvantage of a lack of water-tightness at the contact surface between the upper and the lower elastic strip, since, by virtue of the simple presence of this elastic strip, the fabric composing the gaiter forms, at this point, gathers which facilitate the penetration and ascending movement of water and snow between the gaiter and the boot.

Based on this same embodiment, it would be possible to conceive of an extension of the circumference of the lower end of the gaiter toward the front of the boot in order to yield enhanced protection; however, this cannot be considered because, beyond a certain limit, the elasticity itself of the strip will produce a contraction effect because it slides on the front upper part of the upper toward the instep, thereby making forward extension completely useless.

Austrian Patent No. 387 893 describes a gaiter limited to protection of a low-cut shoe or of the lower portion only of the upper of a high-cut boot. As in the first example cited, this gaiter takes the form of an outer boot enclosing virtually all of the boot upper, with the exception of the tip, in order to leave one binding connection free in the case of a cross-country ski boot, and extending at least partially beneath the sole of this boot. In this instance also, the presence of the lower portion of the gaiter covering the sole even partially complicates manufacture and, moreover, forms an area subject to wear.

German Model of Utility No. 94 26 769.4 differs basically from the preceding patent by virtue of the fact that the upper portion of the gaiter extends beyond the upper of the boot to be protected; however, the lower portion thereof extends in the same manner at least partially beneath the sole, accompanied by the same disadvantages as those previously mentioned.

SUMMARY OF THE INVENTION

To solve these problems, the present invention is intended to offer a gaiter that is simple to manufacture and approximates the structure of a conventional gaiter, but advantageously has an enlarged protective area, protecting the opening/closing area of the upper, while being easy to put in place and capable of being used with functional grabbing areas provided, for example, for ski bindings or ice studs and arranged at the front and rear ends of the boot.

To this end, the invention relates to a water-tight protective gaiter having an overall tubular shape of the type comprising a lower portion covering at least partially the upper of a boot in a front user foot-insertion and foot-closure/tightening area and whose lower end circumference is designed to hug the contour of this upper, and an upper portion designed to envelop the lower leg of the user. An at least partially peripheral flap extending the circumference extends from at least one portion of the end circumference of the lower portion thereof, so as to prolong the extent of its protection beyond this circumference.

The invention in question also concerns the features which will emerge during the following description and which must be considered alone or in all possible technical combinations thereof.

BRIEF DESCRIPTION OF THE DRAWINGS

This description, provided as an example, will allow better understanding of the way in which the invention may be produced, with reference to the attached drawings, in which.

DESCRIPTION OF PREFERRED EMBODIMENT

Figure 1:
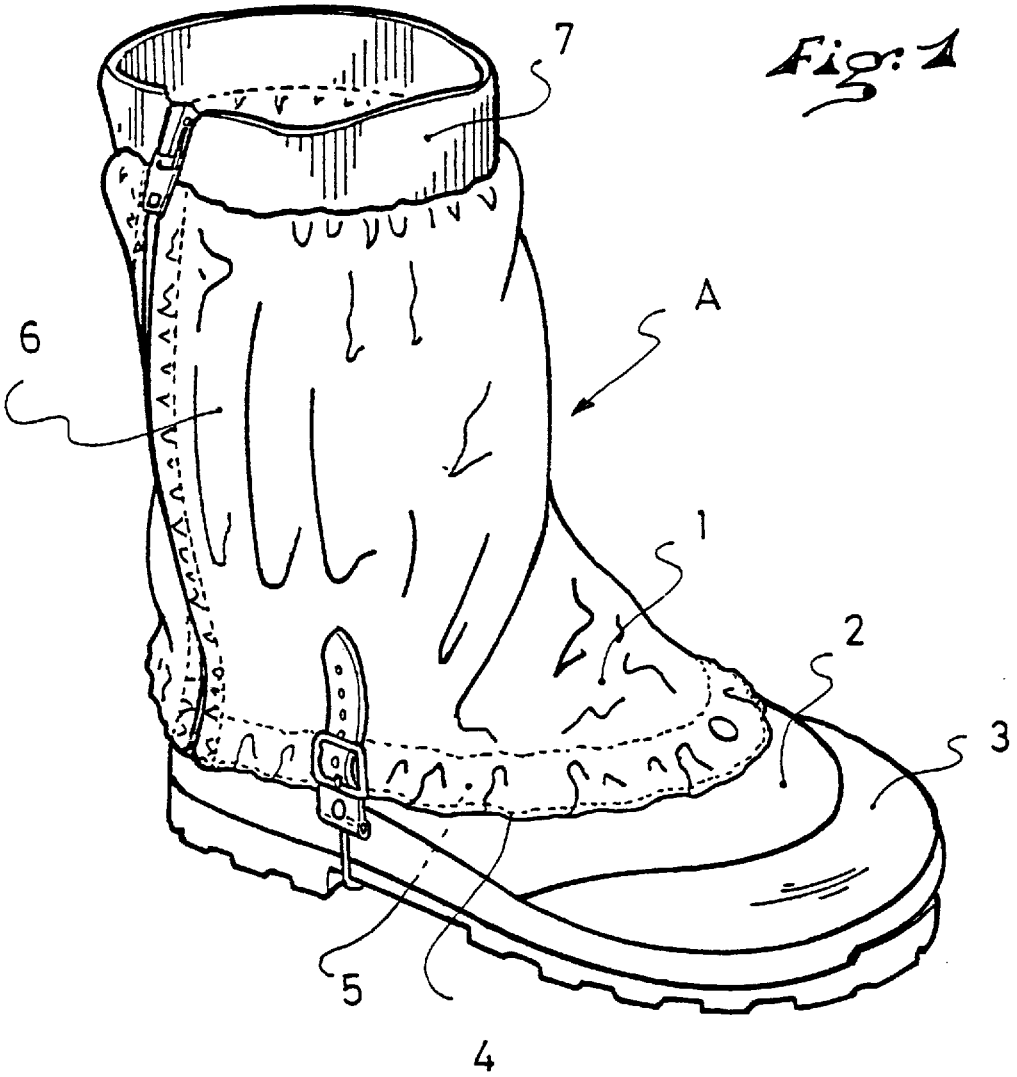
FIG. 1 is a perspective view of a boot equipped with a gaiter according to the prior art.

The prior art gaiter A shown in FIG. 1; is tubular in shape and comprises a lower portion 1 covering, at least partially, the upper 2 of a boot 3 in a front area of insertion (not shown), then an area of closure/tightening of the foot of a user. The lower end circumference 4 incorporates elastic tightening means 5 allowing it to be pressed against the upper, without, however, adopting exactly the contour of the upper 2, because of the deformation produced by the gathers.

Furthermore, the gaiter 1 comprises an upper portion 6 designed to enclose the lower leg of this user. The portion 6 also ends in an elastic enclosing area 7.

Figures 2, 3:
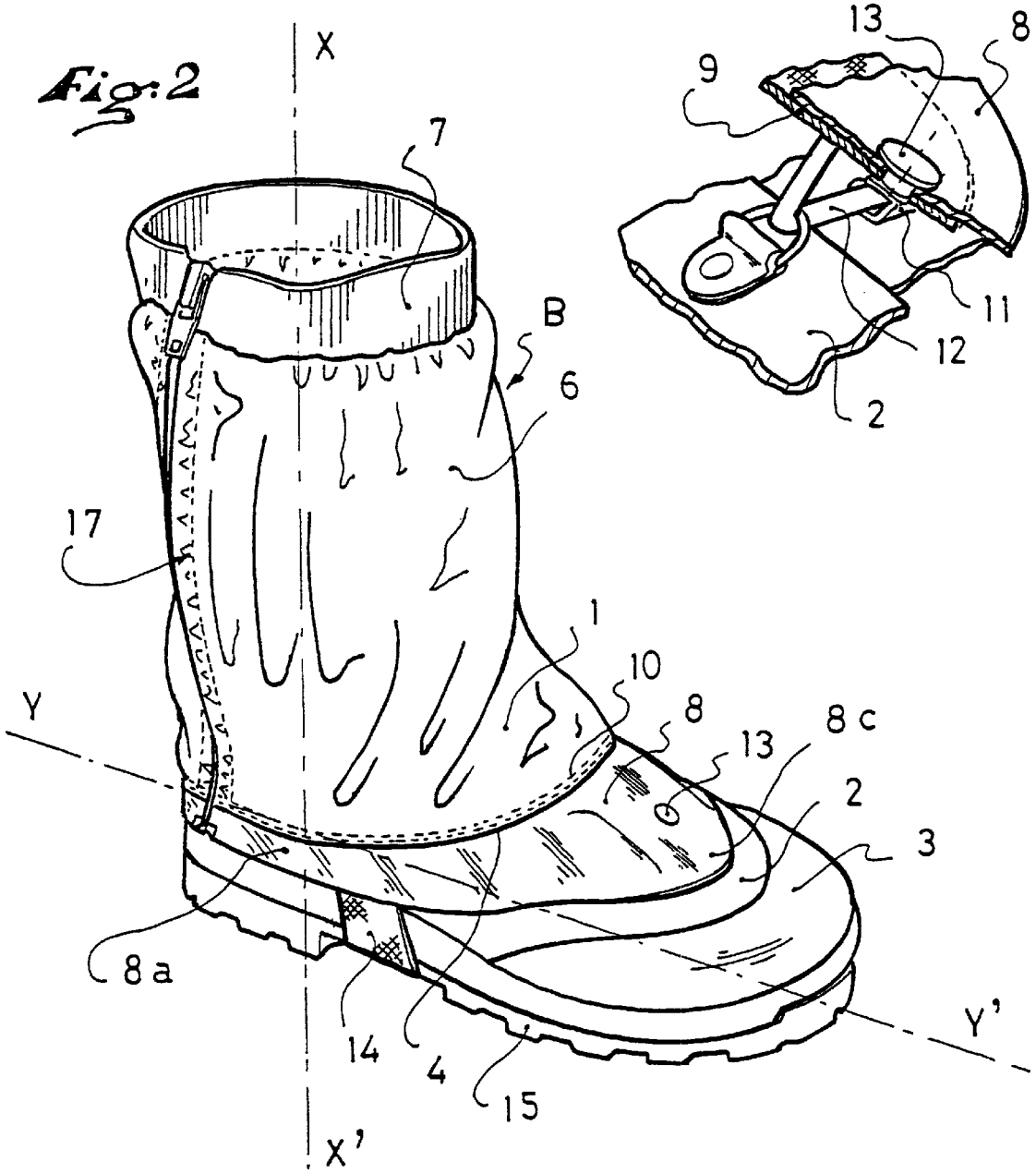
FIG. 2 is a perspective view of a boot equipped with a gaiter according to a first embodiment of the invention.
FIG. 3 is a detail view, on an enlarged scale, of a front mechanism for fastening of the gaiter in FIG. 2.

According to the first embodiment of the invention shown in FIG. 2, the gaiter B is generally distinguished from the prior art gaiter A by virtue of the fact that a peripheral corolla-shaped flap 8 forming an extension of end circumference 4 extends from at least a portion of the end circumference of the lower portion 1 thereof, so as to extend the scope of the protection it provides, while omitting the elastic enclosure means 5 of the prior art.

Flap 8 is made of a water-tight elastic material which nevertheless provides a degree of rigidity so as to be pressed elastically against the upper.

Advantageously, the central portion 8*c* of the flap 8 located on the longitudinal axis yy' of the boot extends beyond the corolla-shaped portion 8 toward the front of the boot 3, so as to increase protection in this area, which is the area comprising the boot-opening/closing means and is, therefore, the most fragile area of the boot.

Figure 5:
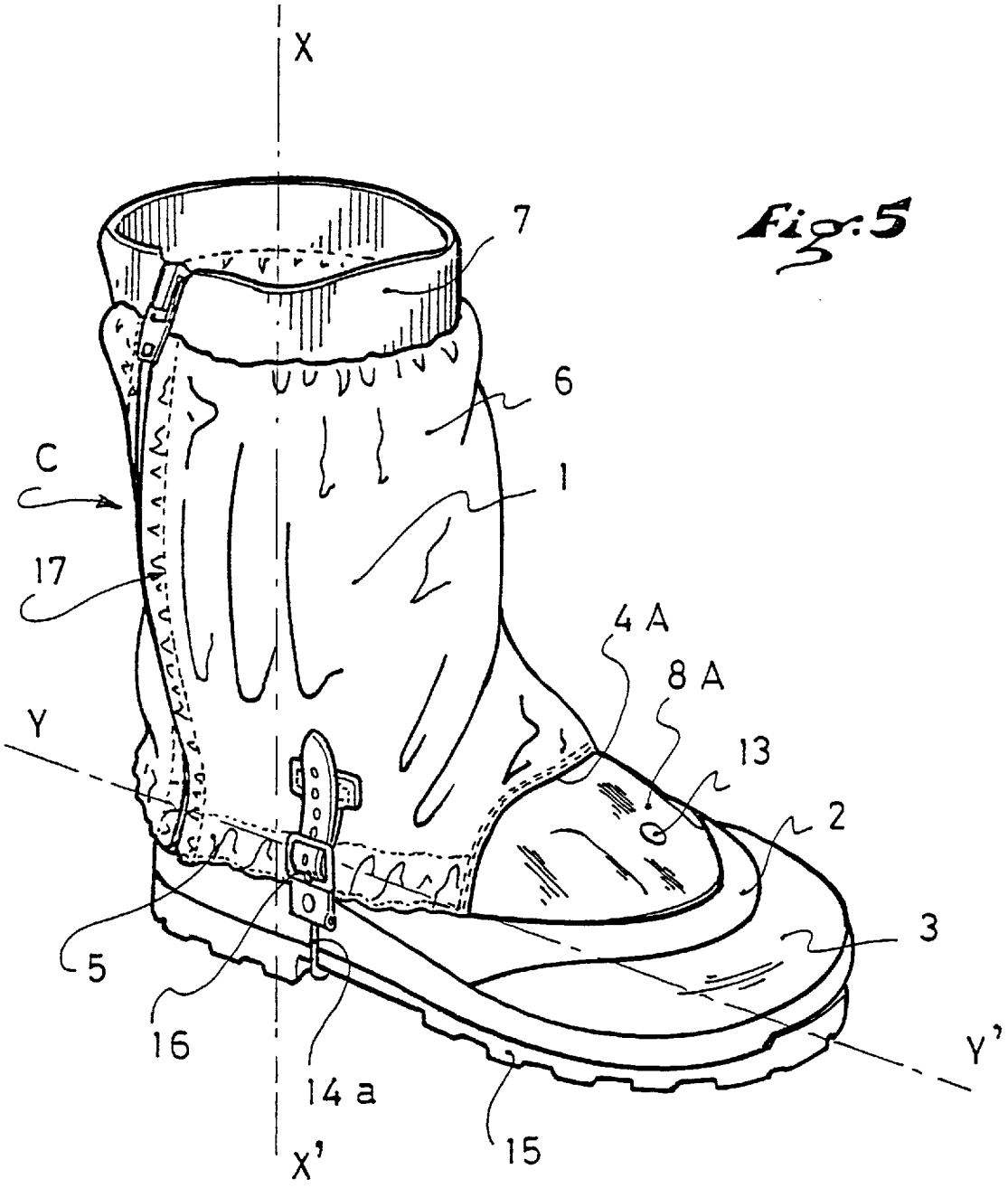
FIG. 5 is a perspective view of a boot equipped with a gaiter, according to a second embodiment of the invention.

The second embodiment, shown on FIG. 5, differs essentially from the preceding one because the flap 8A of the gaiter C extends from the end circumference 4A of the lower portion 1 thereof, only in a central area located on either side of the longitudinal axis yy' of the boot 3 and in relation to the vertical axis xx' of the upper 2, so as to increase the protection it provides in this area, which is the area encompassing the beginning of the upper-opening/closing area.

In this case, the remainder of the lower periphery of the gaiter C is constituted by elastic tightening means 5.

In both cases, the flap 8, 8*a* is formed by an add-on element made of an elastic material, such as rubber, different from the gaiter B, C made of a woven, coated material, and it is connected to the latter by means of a reinforcement piece 9 made of a material that is relatively rigid as compared with the materials used to produce the gaiter B, C and the flap 8, 8A.

In fact, the reinforcement piece 9 is made integral with the gaiter B, C and the flap 8, 8A by hot-gluing and/or by stitching 10.

Figure 4:
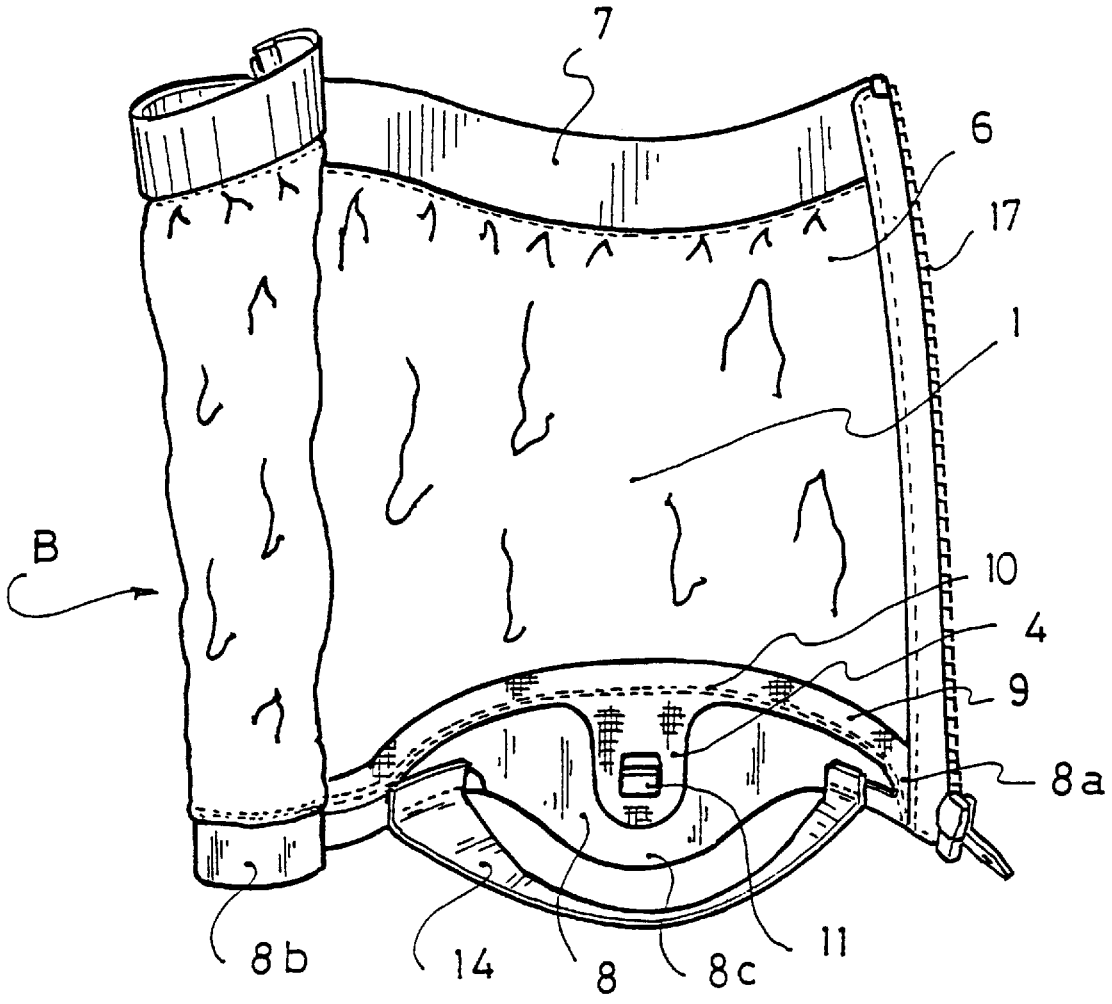
FIG. 4 is an interior view, in unrolled position, of a gaiter according to FIG. 2.

As shown in FIG. 4, the reinforcement piece 9 extends axially forward along the longitudinal dimension of the boot 3 so as to form a rigidified area of the flap 8, 8A, to which a hook 11 positioned centrally on the inner face of the flap 8, 8A is attached by rivet 13, in order to ensure the positive attachment thereof by hooking to the end of an element used to close the insertion area of the upper 2, constituted by a lace 12 (see FIG. 3). Reinforcement piece 9 also extends forward beyond the hook 11, so as to impart energy to the rubber composing the flap 8 by tending to press it against the boot upper even in the presence of snow, thus giving optimal protection of the especially sensitive area in which the lacing 12 begins.

To perfect the attachment of the flap 8, 8A produced by the aforementioned hook, a conventional strap 14 designed to run beneath the sole 15 of the boot 3 and to connect the two opposite lateral areas 8*a*, 8*b* of the corolla-shaped flap 8, 8A runs from the peripheral end circumference 4, 4A, from the lower portion thereof 1, or from the corolla-shaped flap 8, 8A attached thereto, so as to form a fastening mechanism supplementing the flap. Preferably, this strap 14 is made of the same material as the flap 8 and emanates from this flap on one side while being stitched to the other side.

As shown in FIG. 5, this strap could also be replaced by a cable 14*a*, which is connected in stationary fashion to one of the lateral sides of the gaiter C, as well as to tension-adjustment means 16 arranged on the other lateral side.

Finally, gaiter B or C comprises conventional lateral opening and closing means 17 arranged between the end circumferences 7 and 4, 4A of the upper and lower portions 6, 1 respectively, thereby opening the gaiter B or C completely so that it can be placed on, or removed from, the boot 3.

What is claimed is:

1. A water-tight protective gaiter having tubular shape, of the type comprising (a) a lower portion covering at least partially an upper of a boot in a front area of insertion of a foot of a user, said gaiter having a lower end circumference adapted to conform to a contour of said upper, and (b) an upper portion adapted to enclose a lower leg of said user above said upper, wherein an at least partially peripheral flap forming an extension of said lower end circumference extends from at least a portion of said lower end circumference of said lower portion of said gaiter, so as to extend a range of protection of said gaiter beyond said lower end circumference, wherein said flap extends over an entire periphery of said lower circumference, wherein a central portion of said flap extends substantially along a longitudinal axis of said boot toward a front end of said boot, so as to increase protection in said front area, and wherein said flap is made of a material different from a material of said gaiter, and is connected to said gaiter by a reinforcement piece made of a material which is relatively rigid compared to materials used to produce said gaiter and said flap.

2. The gaiter according to claim 1, wherein a strap designed to run beneath a sole of said boot and to connect two opposite lateral areas of said flap extends from the peripheral end circumference, from said lower portion of said gaiter and said flap, in order to constitute and additional mechanism for attachment of said flap.

3. The gaiter according to claim 1, wherein said gaiter comprises lateral opening and closing means arranged between end circumferences of said upper and lower portions thereof, respectively, to permit complete opening of said gaiter in order to allow it to be put in place on, or removed from said boot.

4. A water-tight protective gaiter having a tubular shape, of the type comprising (a) a lower portion covering at least partially an upper of a boot in a front area of insertion of a foot of a user, said gaiter having a lower end circumference adapted to conform to a contour of said upper, and (b) an upper portion adapted to enclose a lower leg of said user above said upper, wherein an at least partially peripheral flap forming an extension of said lower end circumference extends from at least a portion of said lower end circumference of said lower portion of said gaiter, so as to extend a range of protection of said gaiter beyond said lower end circumference, wherein said flap extends over an entire periphery of said lower circumference, wherein a central portion of said flap extends substantially along a longitudinal axis of said boot toward a front end of said boot, so as to increase protection in said front area, and wherein said flap is made of a material different from a material of said gaiter, and is connected to said gaiter by a reinforcement piece made of a material which is relatively rigid compared to materials used to produce said gaiter and said flap, and wherein said flap extends from said lower end circumference of said lower portion only in a central area located on either side of said longitudinal axis of said boot and in relation to a vertical axis of said upper, so as to increase protection in said central area.

5. The gaiter according to claim 4, wherein said reinforcement piece extends axially forward longitudinally of said boot, so as to form a rigidified area of said flap, to which is riveted a hook arranged centrally on an inner face of said flap, in order to ensure positive attachment thereof by hooking to an element designed to close the insertion area of said upper constituted by a lace.

6. A water-tight protective gaiter having a tubular shape, of the type comprising (a) a lower portion covering at least partially an upper of a boot in a front area of insertion of a foot of a user, said gaiter having a lower end circumference adapted to conform to a contour of said upper, and (b) an upper portion adapted to enclose a lower leg of said user above said upper, wherein an at least partially peripheral flap forming an extension of said lower end circumference extends from at least a portion of said lower end circumference of said lower portion of said gaiter, so as to extend a range of protection of said gaiter beyond said lower end circumference, wherein said flap extends from said lower end circumference of said lower portion only in a central area located on either side of a longitudinal axis of said boot and in relation to a vertical axis of said upper, so as to increase protection in said central area, and wherein said flap is made of a material different from a material of said gaiter, and is connected to said gaiter by a reinforcement piece made of a material which is relatively rigid compared to materials used to produce said gaiter and said flap.

* * * * *